US006516857B1

(12) United States Patent
Gajtka et al.

(10) Patent No.: US 6,516,857 B1
(45) Date of Patent: Feb. 11, 2003

(54) INTERCHANGEABLE WINDOW COVERING SYSTEM

(76) Inventors: Edward Gajtka, 215 Murphy Ave., Weirton, WV (US) 26062; Sandra M. Gajtka, 215 Murphy Ave., Weirton, WV (US) 26062

( * ) Notice: Subject to any disclaimer, the term of this patent is extended or adjusted under 35 U.S.C. 154(b) by 0 days.

(21) Appl. No.: 09/944,014

(22) Filed: Aug. 31, 2001

(51) Int. Cl.[7] ..... E06B 3/32
(52) U.S. Cl. ..... 160/107; 49/87.1
(58) Field of Search ..... 160/107, 174 R, 160/327, 89; 49/74.1, 87.1, 463, 465; 52/202

(56) References Cited

U.S. PATENT DOCUMENTS 2,012,034 A * 8/1935 Brent
2,012,388 A * 8/1935 Goodman ..... 52/202
2,620,027 A * 12/1952 Eisenberg ..... 160/327
2,621,724 A * 12/1952 Bergstrom ..... 160/327
3,451,165 A * 6/1969 O'Hair ..... 49/87.1
4,655,003 A * 4/1987 Henley ..... 49/74.1 X
4,841,421 A * 6/1989 Mueller
4,911,220 A * 3/1990 Hiller
4,928,450 A * 5/1990 Rutledge ..... 52/202
5,079,886 A * 1/1992 Downs ..... 52/202 X
5,094,286 A * 3/1992 Hansen
D362,076 S * 9/1995 Graves
5,718,273 A * 2/1998 Best et al.
5,911,660 A * 6/1999 Watson ..... 52/202
6,296,041 B1 * 10/2001 Cicero ..... 160/327

* cited by examiner

*Primary Examiner*—David M. Purol

(57) ABSTRACT

An interchangeable window covering system for providing a plurality of interchangeable widow coverings for a window. The interchangeable window covering system includes a frame member that is designed to be attached to a window, and a plurality of interchangeable window coverings designed to be selectively coupled to the frame member as desired.

12 Claims, 6 Drawing Sheets

INTERCHANGEABLE WINDOW COVERING SYSTEM

BACKGROUND OF THE INVENTION

1. Field of the Invention

The present invention relates to window coverings and more particularly pertains to a new interchangeable window covering system for providing a plurality of interchangeable widow coverings for a window.

2. Description of the Prior Art

The use of window coverings is known in the prior art. More specifically, window coverings heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,718,273; U.S. Pat. No. 5,094,286; U.S. Pat. No. 4,841,421; U.S. Pat. No. 2,012,034; U.S. Pat. No. 4,911,220; and U.S. Pat. No. Des. 362,076.

While these devices fulfill their respective, particular objectives and requirements, the aforementioned patents do not disclose a new interchangeable window covering system. The inventive device includes a frame member that is designed to be attached to a window, and a plurality of interchangeable window coverings designed to be selectively coupled to the frame member as desired.

In these respects, the interchangeable window covering system according to the present invention substantially departs from the conventional concepts and designs of the prior art, and in so doing provides an apparatus primarily developed for the purpose of providing a plurality of interchangeable widow coverings for a window.

SUMMARY OF THE INVENTION

In view of the foregoing disadvantages inherent in the known types of window coverings now present in the prior art, the present invention provides a new interchangeable window covering system construction wherein the same can be utilized for providing a plurality of interchangeable widow coverings for a window.

The general purpose of the present invention, which will be described subsequently in greater detail, is to provide a new interchangeable window covering system apparatus and method which has many of the advantages of the window coverings mentioned heretofore and many novel features that result in a new interchangeable window covering system which is not anticipated, rendered obvious, suggested, or even implied by any of the prior art window coverings, either alone or in any combination thereof.

To attain this, the present invention generally comprises a frame member that is designed to be attached to a window, and a plurality of interchangeable window coverings designed to be selectively coupled to the frame member as desired.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new interchangeable window covering system apparatus and method which has many of the advantages of the window coverings mentioned heretofore and many novel features that result in a new interchangeable window covering system which is not anticipated, rendered obvious, suggested, or even implied by any of the prior art window coverings, either alone or in any combination thereof.

It is another object of the present invention to provide a new interchangeable window covering system that may be easily and efficiently manufactured and marketed.

It is a further object of the present invention to provide a new interchangeable window covering system that is of a durable and reliable construction.

An even further object of the present invention is to provide a new interchangeable window covering system which is susceptible of a low cost of manufacture with regard to both materials and labor, and which accordingly is then susceptible of low prices of sale to the consuming public, thereby making such interchangeable window covering system economically available to the buying public.

Still yet another object of the present invention is to provide a new interchangeable window covering system that provides in the apparatuses and methods of the prior art some of the advantages thereof, while simultaneously overcoming some of the disadvantages normally associated therewith.

Still another object of the present invention is to provide a new interchangeable window covering system for providing a plurality of interchangeable widow coverings for a window.

Yet another object of the present invention is to provide a new interchangeable window covering system that includes a frame member that is designed to be attached to a window, and a plurality of interchangeable window coverings designed to be selectively coupled to the frame member as desired.

Still yet another object of the present invention is to provide a new interchangeable window covering system that allows the decor of a room to be changed with ease.

Even still another object of the present invention is to provide a new interchangeable window covering system that is suitable for all room s and windows including residential and commercial establishments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
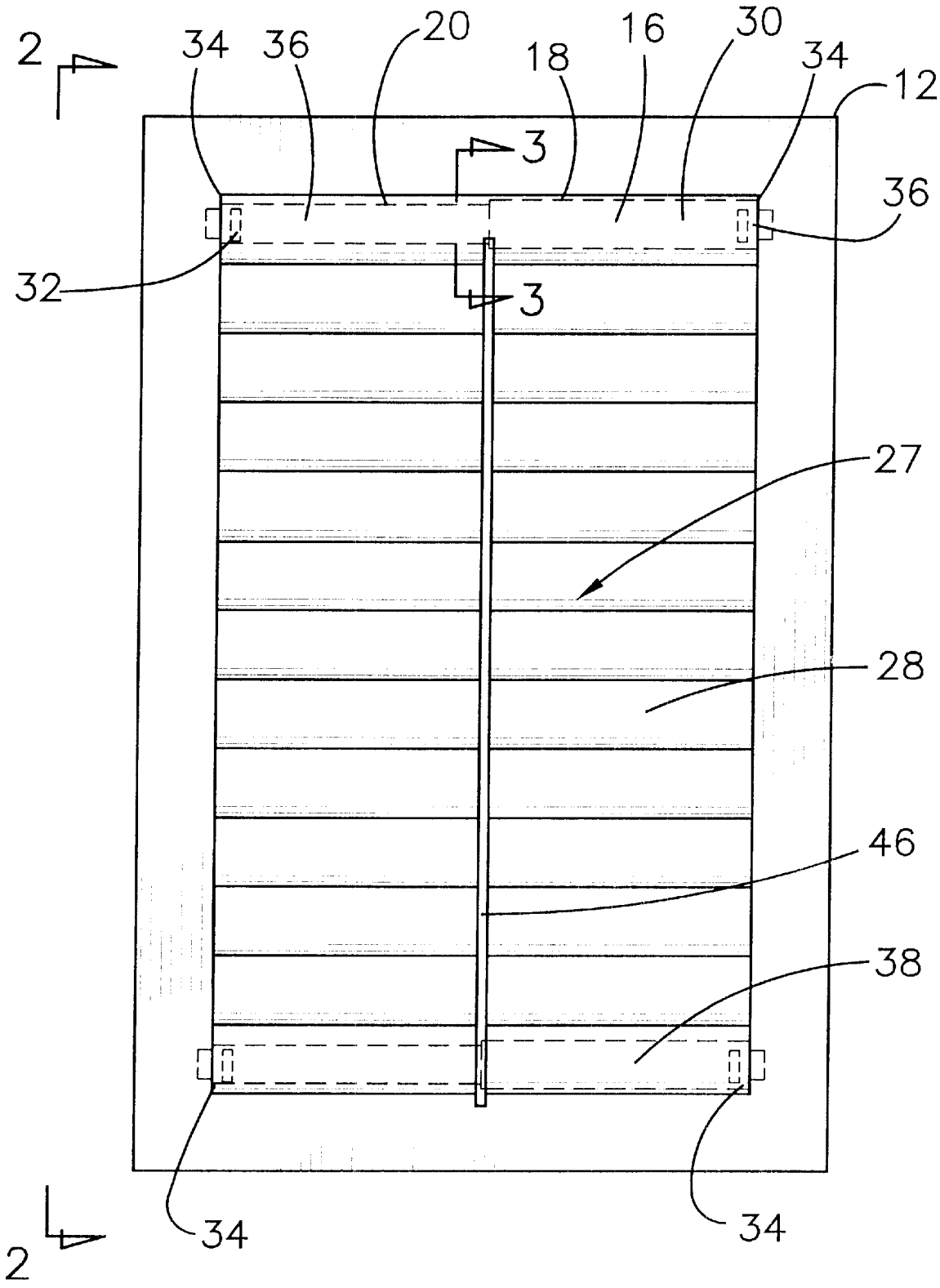
FIG. 1 is a schematic front view of the venetian blind panel assembly of a new interchangeable window covering system according to the present invention.
Figure 2:
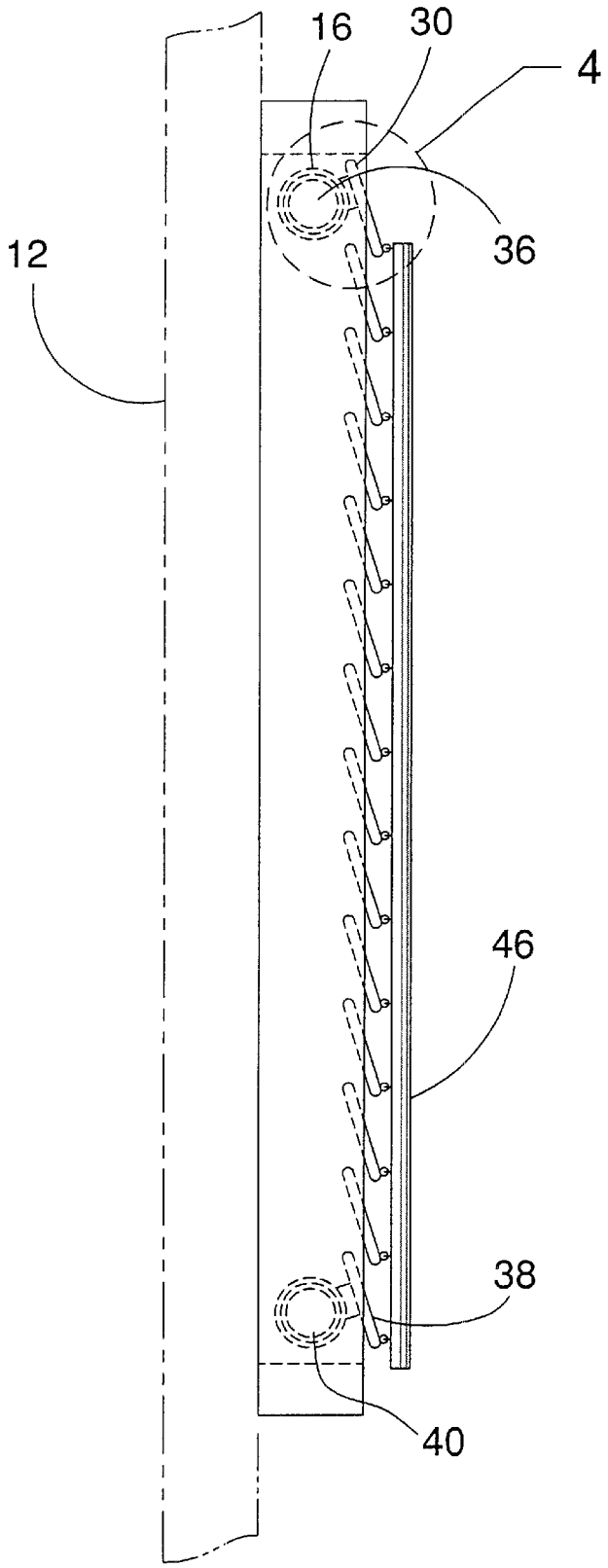
FIG. 2 is a schematic side view of the venetian blind panel assembly of the present invention.
Figure 3:
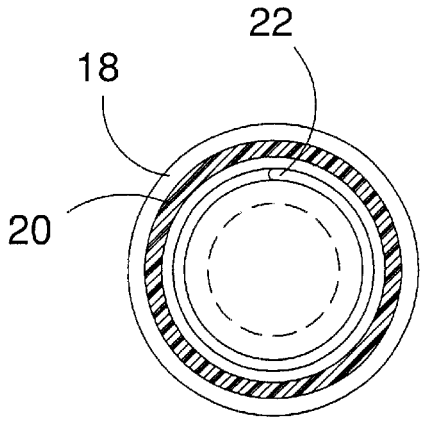
FIG. 3 is a schematic cross-sectional view of the rod member of the present invention.
Figure 4:
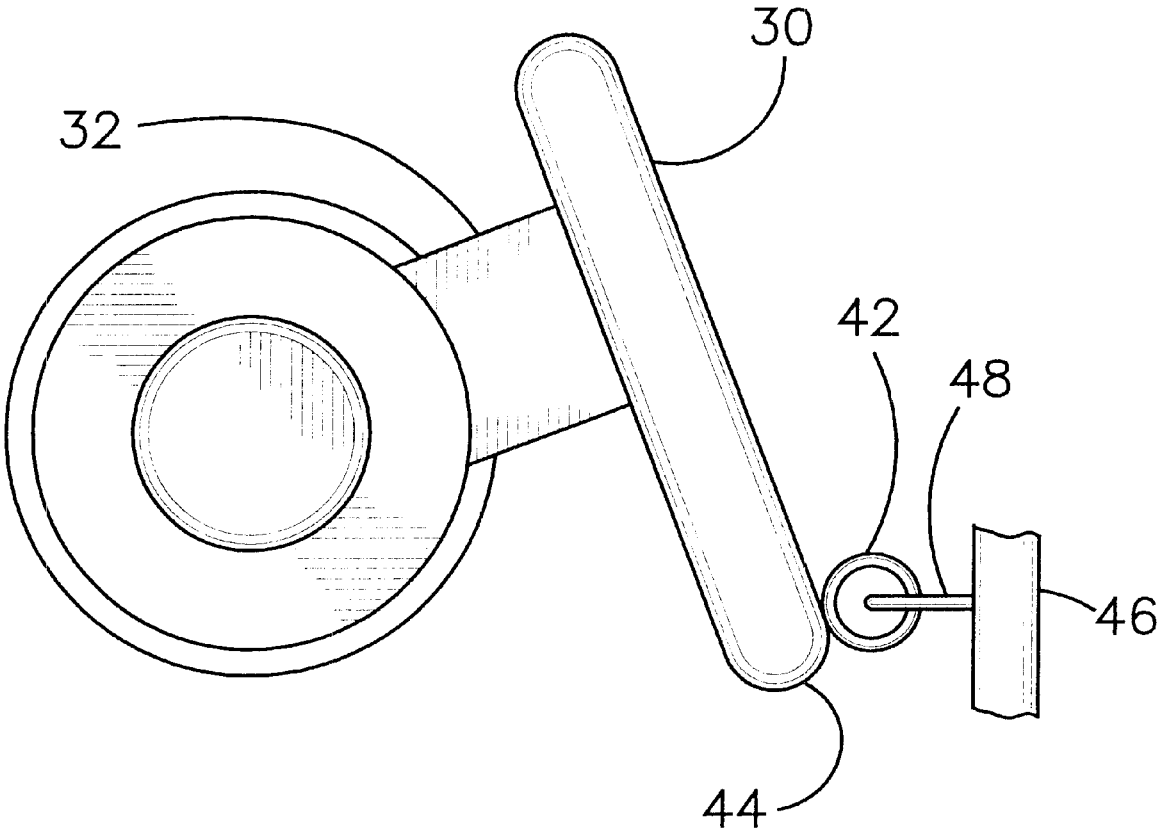
FIG. 4 is a schematic side view of the rod member in conjuction with the venetian blind panel assembly of the present invention.
Figure 5:
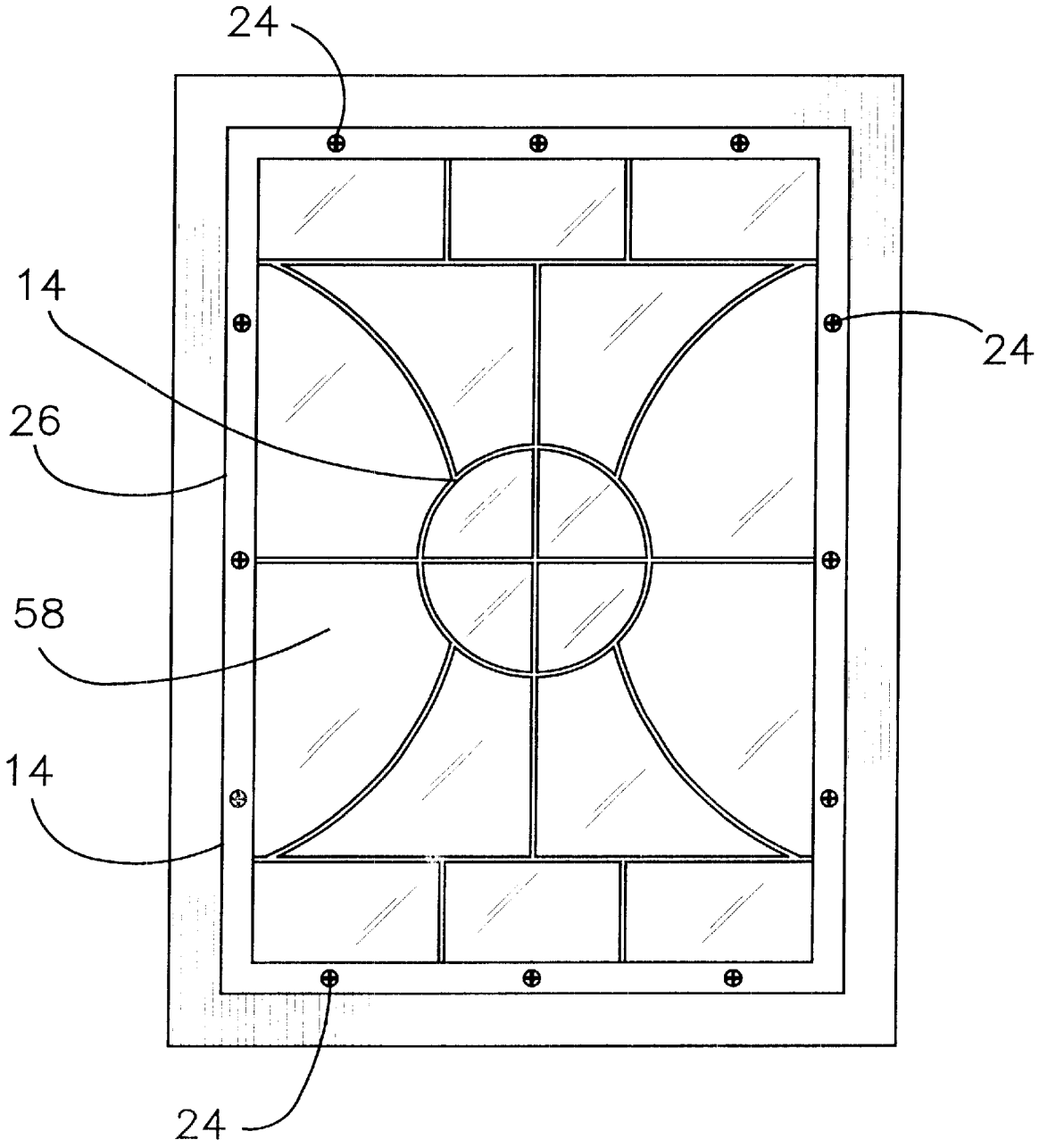
FIG. 5 is a schematic front view of a decorative glass panel assembly of the present invention.
Figure 6:
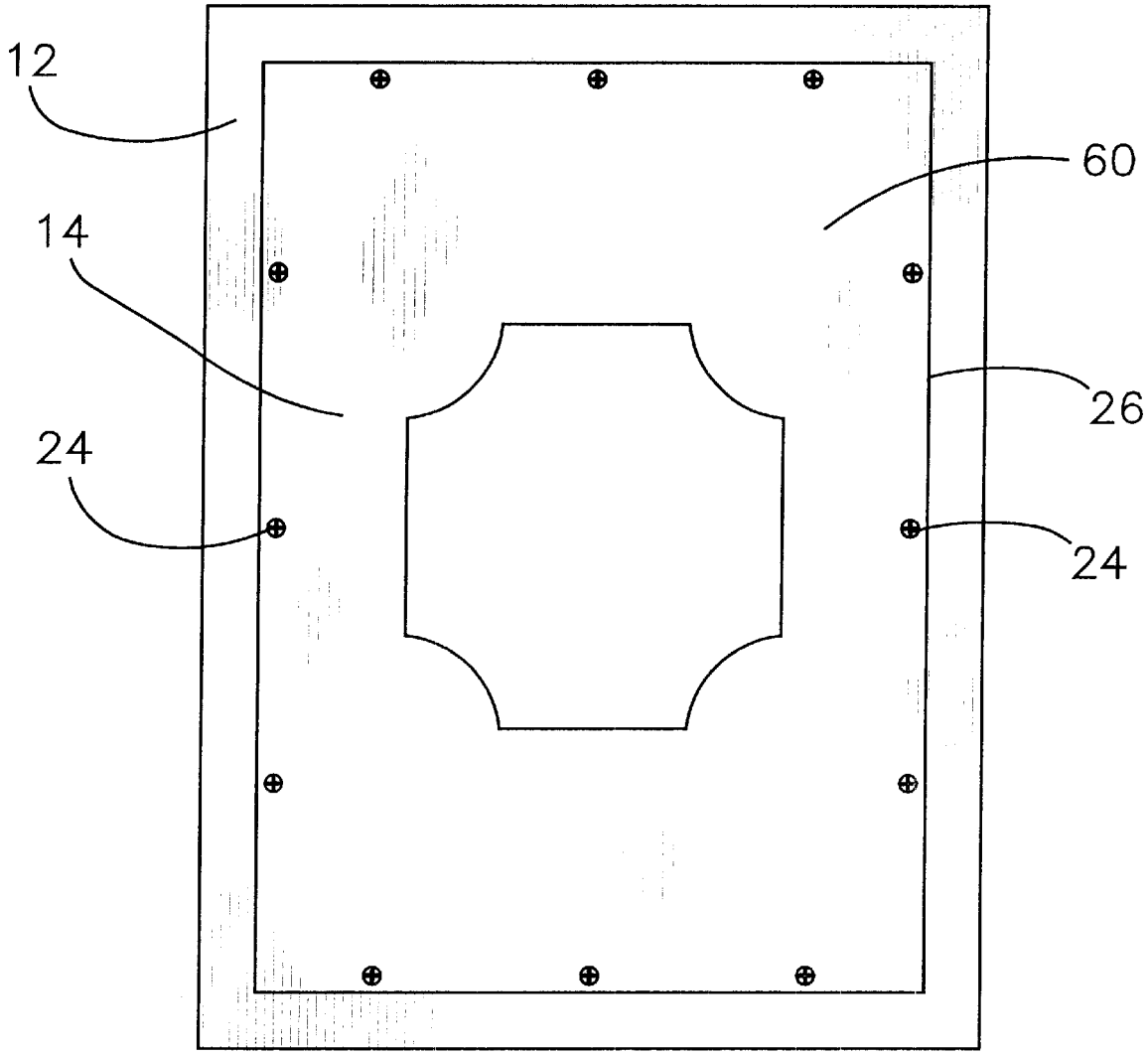
FIG. 6 is a schematic front view of a decorative solid panel of the present invention.
Figure 7:
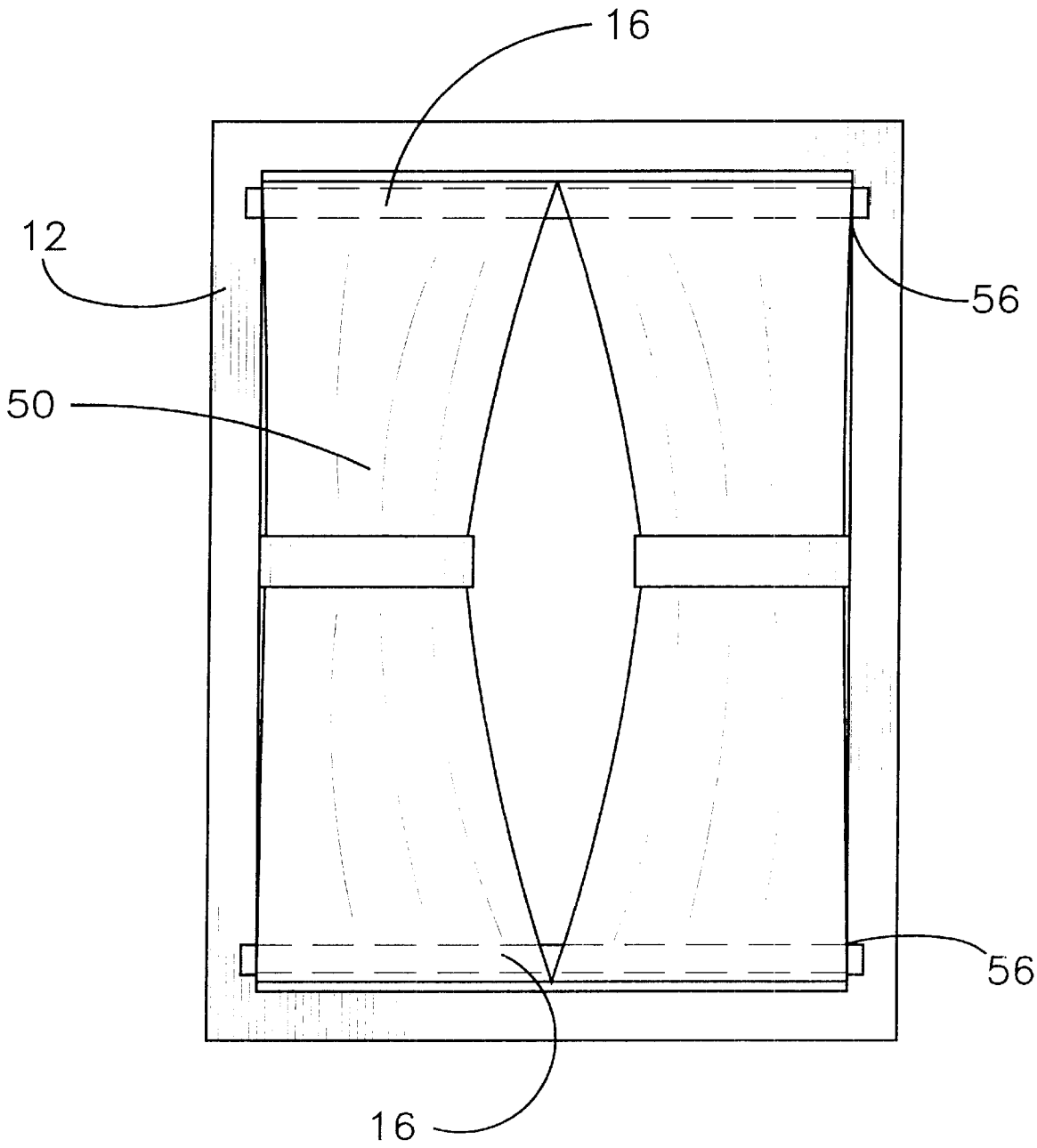
FIG. 7 is a schematic front view of a decorative fabric panel of the present invention.

With reference now to the drawings, and in particular to FIGS. 1 through 7 thereof, a new interchangeable window covering system embodying the principles and concepts of the present invention and generally designated by the reference numeral will be described.

As best illustrated in FIGS. 1 through 7, the interchangeable window covering system 10 generally comprises a frame member 12 is substantially the same size as the window. The frame member 12 is designed for coupling to a window.

A plurality of panel assemblies 14 is selectively couplable to the frame member 12 such that a user is able to interchange the panel assemblies 14 as desired.

The panel assemblies 14 have a plurality of coupling systems. The coupling systems are designed for selectively attaching the panel assemblies 14 to the frame member 12.

One of the plurality of coupling systems comprises multiple rod members 16. The rod members 16 are designed for being insertable inside the frame member 12.

The rod members 16 have a first portion 18 and a second portion 20. The first portion 18 of the rod members 16 is designed for telescopically receiving the second portion 20 of the rod members 16.

The rod members 16 include a spring 22 situated within the rod members 16 between the portions such that the portions are biased outwardly.

The rod members 16 are insertable into the frame member 12 when the portions are manually biased together such that upon insertion of the rod member into the frame member 12, the portions are biased outwardly by the spring 22 thereby facilitating coupling of the rod members 16 to the frame member 12.

One of the plurality of coupling systems comprises multiple fastening members 24. The fastening members 24 are positioned around a perimeter 26 of the panel assemblies such that the fastening members 24 facilitate the coupling of the panel assemblies to the frame member 12.

One of the panel assemblies 14 comprises a venetian blind assembly 27. The venetian blind assembly 27 has a plurality of slat members 28. An upper slat member 30 has a connecting portion 32 that is fixedly coupled proximate distal ends 34 of an upper one of the rod members 38.

A lower slat member is fixedly coupled to a lower one of the rod members 40 16 proximate distal ends 34 of the lower one of the rod members 40.

The slat members 28 have a plurality of slat eyelets 42. The slat eyelets 42 are positioned along a lower edge 44 of the slat members 28 at a medial position along a longitudinal axis of the slat members 28.

A slat control arm 46 is elongate such that the slat control arm 46 extends between the upper slat member 30 and the lower slat member.

The slat control arm 46 has a plurality of control arm eyelets 48. The control arm eyelets 48 are inter-linked with the slat eyelets 42 such that when the slat control arm 46 is vertically repositioned, the slat members 28 are pivoted around the longitudinal axis of the slat members 28 thereby altering a sight limit through the venetian blind assembly 27 and the window.

One of the panel assemblies 14 comprises a curtain member 50. The curtain member 50 has a top end 52 and a bottom end 54. The top and bottom end 52, 54 of the curtain member 50 have an aperture 56. The aperture 56 extends along a longitudinal axis of the top and bottom end 52, 54 such that the apertures 56 are designed for receiving the rod members 16 thereby allowing the curtain member 50 to be selectively coupled to the frame member 12 for covering the window.

One of the panel assemblies 14 comprises a decorative glass member 58. The decorative glass member 58 has a plurality of the fastening members 24 for coupling the decorative glass member 58 to the frame member 12 for covering the window.

One of the panel assemblies 14 comprises a decorative solid member 60. The decorative solid member 60 has a plurality of the fastening members 24 for coupling the decorative solid member 60 to the frame member 12 for covering the window.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A interchangeable window-covering system for providing a plurality of window covers for a window, the interchangeable window-covering system comprising:

a frame member, said frame member being substantially the same size as the window, said frame member being adapted for coupling to a window;

a plurality of panel assemblies, said panel assemblies being selectively couplable to said frame member such that a user is able to interchange said panel assemblies as desired;

said panel assemblies having a plurality of coupling systems, said coupling systems being adapted for selectively attaching said panel assemblies to said frame member;

one of said plurality of coupling systems comprising multiple rod members, said rod members being adapted for being releasably positionable inside said frame member;

one of said panel assemblies comprising a venetian blind assembly, said venetian blind assembly having a plurality of slat members, an upper slat member having a connecting portion, said connecting portion being fixedly coupled proximate distal ends of an upper one of said rod members;

a lower slat member being fixedly coupled to a lower one of said rod members proximate distal ends of said lower one of said rod members;

said slat members having a plurality of slat eyelets, said slat eyelets being positioned along a lower edge of said slat members at a medial position along a longitudinal axis of said slat members;

a slat control arm, said slat control arm being elongate such that said slat control arm extending between said upper slat member and said lower slat member; and said slat control arm having a plurality of control arm eyelets, said control arm eyelets being inter-linked with said slat eyelets such that when said slat control arm is vertically repositioned, said slat members are pivoted around the longitudinal axis of said slat members thereby altering a sight limit through said venetian blind assembly and the window.

2. The interchangeable window-covering system assemblies set forth in claim 1, further comprising:

said rod members having a first portion and a second portion, said first portion of said rod members being adapted for telescopically receiving said second portion of said rod members;

said rod members including a spring, said spring being situated within said rod members between said portions such that said portions are biased outwardly; and said rod members being insertable into said frame member when said portions are manually biased together such that upon insertion of said rod member into said frame member, said portions are biased outwardly by said spring thereby facilitating coupling of said rod members to said frame member.

3. The interchangeable window-covering system assemblies set forth in claim 1, further comprising:

one of said plurality of coupling systems comprising multiple fastening members, said fastening members being positioned around a perimeter of said panel members such that said fastening members facilitate the coupling of said panel members to said frame member.

4. The interchangeable window-covering system assemblies set forth in claim 1 wherein one of said panel assemblies comprises:

a curtain member, said curtain member having a top end and a bottom end, said top and bottom ends of said curtain member having an aperture, said aperture extending along a longitudinal axis of said top and bottom ends such that said apertures being adapted for receiving said rod members thereby allowing said curtain member to be selectively coupled to said frame member for covering the window.

5. The interchangeable window-covering system assemblies set forth in claim 3 wherein one of said panel assemblies comprises:

a decorative glass member, said decorative glass member having a plurality of said fastening members for coupling said decorative glass member to said frame member for covering the window.

6. The interchangeable window-covering system assemblies set forth in claim 3 wherein one of said panel assemblies comprises:

a decorative solid panel, said decorative solid panel having a plurality of said fastening members for coupling said decorative solid member to said frame member for covering the window.

7. A interchangeable window-covering system for providing a plurality of window covers for a window, the interchangeable window-covering system comprising:

a frame member, said frame member being substantially the same size as the window, said frame member being adapted for coupling to a window;

a plurality of panel assemblies, said panel assemblies being selectively couplable to said frame member such that a user is able to interchange said panel assemblies as desired;

said panel assemblies having a plurality of coupling systems, said coupling systems being adapted for selectively attaching said panel assemblies to said frame member;

one of said plurality of coupling systems comprising multiple rod members, said rod members being adapted for being insertable inside said frame member;

said rod members having a first portion and a second portion, said first portion of said rod members being adapted for telescopically receiving said second portion of said rod members;

said rod members including a spring, said spring being situated within said rod members between said portions such that said portions are biased outwardly;

said rod members being insertable into said frame member when said portions are manually biased together such that upon insertion of said rod member into said frame member, said portions are biased outwardly by said spring thereby facilitating coupling of said rod members to said frame member;

one of said plurality of coupling systems comprising multiple fastening members, said fastening members being positioned around a perimeter of said panel members such that said fastening members facilitate the coupling of said panel members to said frame member;

wherein one of said panel assemblies comprises a venetian blind assembly, said Venetian blind assembly having a plurality of slat members, an upper slat member having a connecting portion, said connecting portion being fixedly coupled proximate distal ends of an upper one of said rod members;

a lower slat member being fixedly coupled to a lower one of said rod members proximate distal ends of said lower one of said rod members;

said slat members having a plurality of slat eyelets, said slat eyelets being positioned along a lower edge of said slat members at a medial position along a longitudinal axis of said slat members;

a slat control arm, said slat control arm being elongate such that said slat control arm extending between said upper slat member and said lower slat member;

said slat control arm having a plurality of control arm eyelets, said control arm eyelets being inter-linked with said slat eyelets such that when said slat control arm is vertically repositioned, said slat members are pivoted around the longitudinal axis of said slat members thereby altering a sight limit through said venetian blind assembly and the window;

wherein one of said panel assemblies comprises a curtain member, said curtain member having a top end and a bottom end, said top and bottom ends of said curtain member having an aperture, said aperture extending along a longitudinal axis of said top and bottom ends such that said apertures being adapted for receiving said rod members thereby allowing said curtain member to be selectively coupled to said frame member for covering the window;

wherein one of said panel assemblies comprises a decorative glass member, said decorative glass member having a plurality of said fastening members for coupling said decorative glass member to said frame member for covering the window;

wherein one of said panel assemblies comprises a decorative solid panel, said decorative solid panel having a plurality of said fastening members for coupling said decorative solid panel to said frame member for covering the window.

8. A interchangeable window-covering system for providing a plurality of window covers for a window, the interchangeable window-covering system comprising:

a frame member, said frame member being substantially the same size as the window, said frame member being adapted for coupling to a window;

a plurality of panel assemblies, said panel assemblies being selectively couplable to said frame member such that a user is able to interchange said panel assemblies as desired;

said panel assemblies having a plurality of coupling systems, said coupling systems being adapted for selectively attaching said panel assemblies to said frame member;

one of said plurality of coupling systems comprising multiple rod members, said rod members being adapted for being releasably positionable inside said frame member;

said rod members having a first portion and a second portion, said first portion of said rod members being adapted for telescopically receiving said second portion of said rod members;

said rod members including a spring, said spring being situated within said rod members between said portions such that said portions are biased outwardly;

said rod members being insertable into said frame member when said portions are manually biased together such that upon insertion of said rod member into said frame member, said portions are biased outwardly by said spring thereby facilitating coupling of said rod members to said frame member;

one of said panel assemblies comprising a venetian blind assembly, said venetian blind assembly having a plurality of slat members, an upper slat member having a connecting portion, said connecting portion being fixedly coupled proximate distal ends of an upper one of said rod members;

a lower slat member being fixedly coupled to a lower one of said rod members proximate distal ends of said lower one of said rod members;

said slat members having a plurality of slat eyelets, said slat eyelets being positioned along a lower edge of said slat members at a medial position along a longitudinal axis of said slat members;

a slat control arm, said slat control arm being elongate such that said slat control arm extending between said upper slat member and said lower slat member; and said slat control arm having a plurality of control arm eyelets, said control arm eyelets being inter-linked with said slat eyelets such that when said slat control arm is vertically repositioned, said slat members are pivoted around the longitudinal axis of said slat members thereby altering a sight limit through said venetian blind assembly and the window.

9. The interchangeable window-covering system assemblies set forth in claim 8, further comprising:

one of said plurality of coupling systems comprising multiple fastening members, said fastening members being positioned around a perimeter of said panel members such that said fastening members facilitate the coupling of said panel members to said frame member.

10. The interchangeable window-covering system assemblies set forth in claim 8 wherein one of said panel assemblies comprises:

a curtain member, said curtain member having a top end and a bottom end, said top and bottom ends of said curtain member having an aperture, said aperture extending along a longitudinal axis of said top and bottom ends such that said apertures being adapted for receiving said rod members thereby allowing said curtain member to be selectively coupled to said frame member for covering the window.

11. The interchangeable window-covering system assemblies set forth in claim 9 wherein one of said panel assemblies comprises:

a decorative glass member, said decorative glass member having a plurality of said fastening members for coupling said decorative glass member to said frame member for covering the window.

12. The interchangeable window-covering system assemblies set forth in claim 9 wherein one of said panel assemblies comprises:

a decorative solid panel, said decorative solid panel having a plurality of said fastening members for coupling said decorative solid member to said frame member for covering the window.

* * * * *